US007597244B2

(12) United States Patent
Boldrini et al.

(10) Patent No.: US 7,597,244 B2
(45) Date of Patent: Oct. 6, 2009

(54) CONTAINER

(75) Inventors: Fulvio Boldrini, Ferrara (IT); Roberto Ghiotti, Calderino Di Monte San Pietro (IT)

(73) Assignee: Azionaria Costruzioni Macchine Automatiche A.C.M.A. S.p.A., Bologna (IT)

( * ) Notice: Subject to any disclaimer, the term of this patent is extended or adjusted under 35 U.S.C. 154(b) by 398 days.

(21) Appl. No.: 10/502,122

(22) PCT Filed: Jan. 9, 2003

(86) PCT No.: PCT/IB03/00062

§ 371 (c)(1),
(2), (4) Date: Jul. 16, 2004

(87) PCT Pub. No.: WO03/059762

PCT Pub. Date: Jul. 24, 2003

(65) Prior Publication Data

US 2005/0061862 A1 Mar. 24, 2005

(30) Foreign Application Priority Data

Jan. 21, 2002 (IT) ..... BO2002A0024

(51) Int. Cl.
*B65D 43/04* (2006.01)

(52) U.S. Cl. ..... 229/125.14; 229/125.17; 229/110

(58) Field of Classification Search ..... 229/125.14, 229/125.15, 131.1, 800, 125.04; 215/220, 215/43, 44; 222/574
See application file for complete search history.

(56) References Cited

U.S. PATENT DOCUMENTS

| | | | | |
|---|---|---|---|---|
| 1,100,448 | A | 6/1914 | Selz | |
| 2,819,001 | A | 1/1958 | Pottle | |
| 3,690,524 | A * | 9/1972 | Haberhauer | 222/573 |
| 4,903,848 | A * | 2/1990 | Chattman | 215/227 |
| 5,046,660 | A | 9/1991 | Magnoni | |

(Continued)

FOREIGN PATENT DOCUMENTS

GB 2236095 A * 3/1991

(Continued)

OTHER PUBLICATIONS

Patent Abstracts of Japan, vol. 1998, No. 1, Jan. 30, 1998 & JP 09 226755 A (Toppan Printing Co Ltd.), Sep. 2, 1997.
International Search Report dated Oct. 17, 2003.

*Primary Examiner*—Nathan J Newhouse
*Assistant Examiner*—Christopher Demeree
(74) *Attorney, Agent, or Firm*—Timothy J. Klima; Shuttleworth & Ingersoll, PLC

(57) ABSTRACT

A container (1) for liquid products fashioned from at least one blank of multi-layer paper material comprises an essentially parallelepiped body (2) with four side walls (4, 5, 6, 7), and a top section (9) presenting four angled faces (4*a*, 5*a*, 6*a*, 7*a*) that converge toward a tubular element (17) providing a spout (15) from which to pour the liquid contents. The tubular element (17) also presents four tags (24) designed to interact with the top section (9); the tags function as anchors insertable between and weldable together with the corresponding edges (11) of the blank to form joined areas (12) serving as both closure and reinforcing elements in the finished container (1).

11 Claims, 5 Drawing Sheets

U.S. PATENT DOCUMENTS

| | | | | |
|---|---|---|---|---|
| 5,088,642 | A * | 2/1992 | Farber | 229/125.14 |
| 5,176,313 | A * | 1/1993 | Curry et al. | 229/125.15 |
| 6,016,953 | A * | 1/2000 | Stacy-Ryan et al. | 229/125.15 |
| 6,478,175 | B1 * | 11/2002 | Tuckner et al. | 215/329 |
| 2001/0008252 | A1 * | 7/2001 | Ammons et al. | 229/184 |

FOREIGN PATENT DOCUMENTS

| | | |
|---|---|---|
| WO | 01/76966 | 10/2001 |
| WO | 03/078258 | 9/2003 |

* cited by examiner

CONTAINER

This application is the National Phase of International Application PCT/IB03/00062 filed Jan. 9, 2003 which designated the U.S. and that International Application was published under PCT Article 21(2) in English.

TECHNICAL FIELD

The present invention relates to a container furnished with a spout from which to pour or extract the product it contains.

In particular, albeit with no limitation in general scope implied, the present invention relates to a container for liquid products, and typically food products such as mineral water, milk, fruit juices, yoghurt and the like.

BACKGROUND ART

The art field of bottling and packaging applicable to the aforementioned products embraces containers appearing as a hollow body of multi-layer paper material, typically cardboard or paperboard, coated with one or more layers of food-safe material suitable in particular for liquids.

A container of the type in question is fashioned from a flat diecut blank, detached generally from a roll and then folded along precreased lines in such a way as to form a recipient capable of holding the products in question.

The recipient remains open at the top so that it can be filled, and thereafter, the edges of the blank delimiting the open top are joined and sealed together to provide the container with a hermetic closure.

An alternative practice conventionally adopted is to attach a rigid tubular element or "neck" to the top of the container, which provides a spout from which to pour the product and can be coupled with a relative cap providing the closure for the container.

The rigid tubular element in question is secured to the portion of the blank constituting the top of the container, normally by means of a heat-weld or using a hot-melt adhesive.

In the event of the rigid tubular element being attached at a point coinciding with the joined edges of the blank, it can prove particularly difficult to obtain a hermetic seal.

Consequently, one of the drawbacks connected with this type of solution is that the provision of a hermetic closure on the container by conventional methods is particularly complex and difficult to achieve, and may involve the use of significant quantities of adhesive and/or weld material.

The object of the present invention is to provide a container for products of the type in question such as will remain unaffected by the aforementioned drawbacks, as well as being functional, practical and inexpensive to produce.

DISCLOSURE OF THE INVENTION

The stated object is realized according to the present invention in a container fashioned from a blank of multi-layer paper material, comprising a tubular element associated with a top section of the container and providing a spout from which to pour a product held internally of the selfsame container, the top section including at least two edges of the blank united in lapping contact to establish a joined area, characterized in that the tubular element affords at least one projection interposable between the edges of the blank and welded together with at least a portion of the area along which the selfsame edges are joined.

The invention will now be described in detail, by way of example, with the aid of the accompanying drawings, in which.

With reference to the drawings, the container to which the present invention relates is denoted 1, in its entirety.

The container 1 is erected from one or more blanks (not illustrated) of multi-layer paper material, such as cardboard or paperboard coated with a film of food-safe material at least on the surface exposed to the product.

Figure 1:
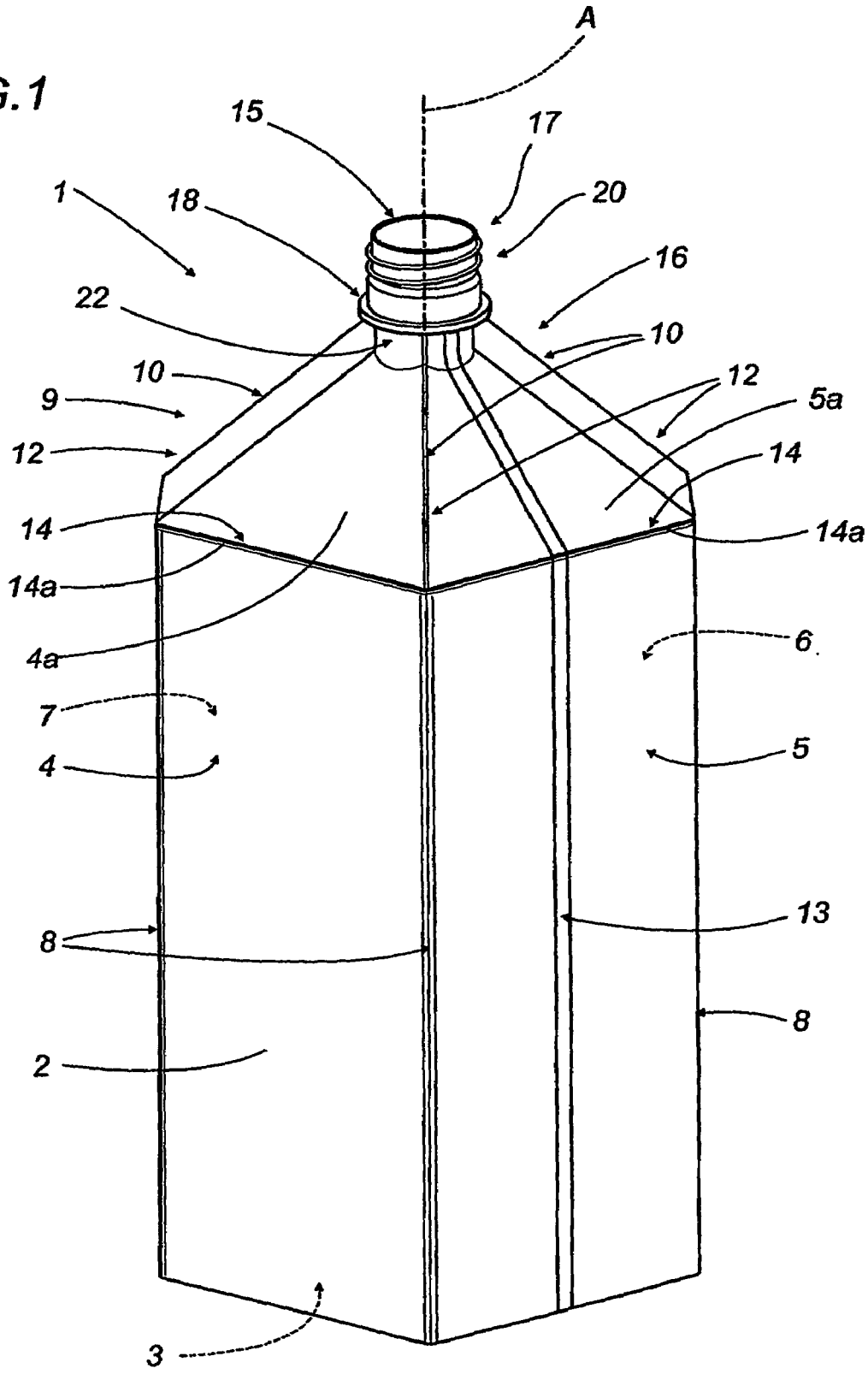
FIG. 1 illustrates a container embodied in accordance with the present invention, viewed in perspective from above.
Figure 2:
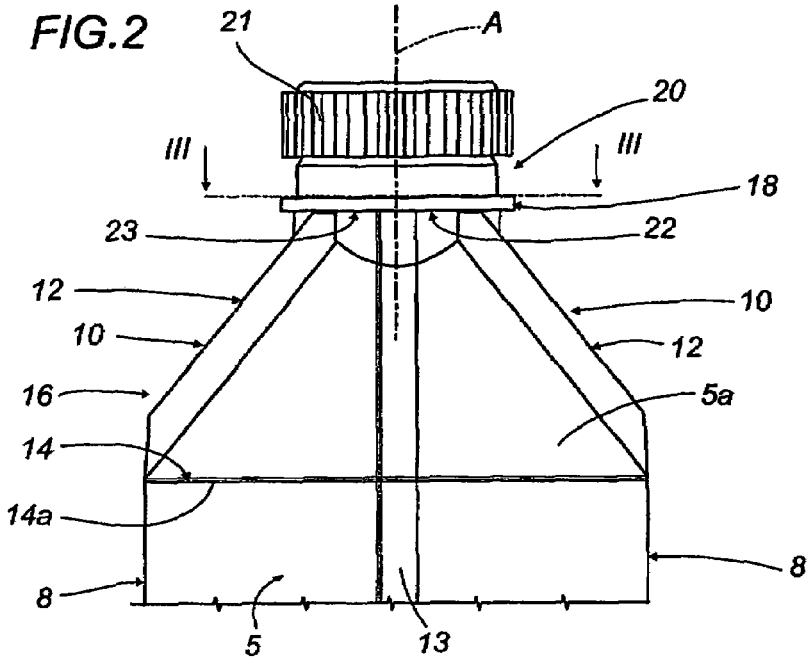
FIG. 2 illustrates a portion of the container of FIG. 1 furnished with a cap, viewed in a schematic side elevation.
Figure 3:
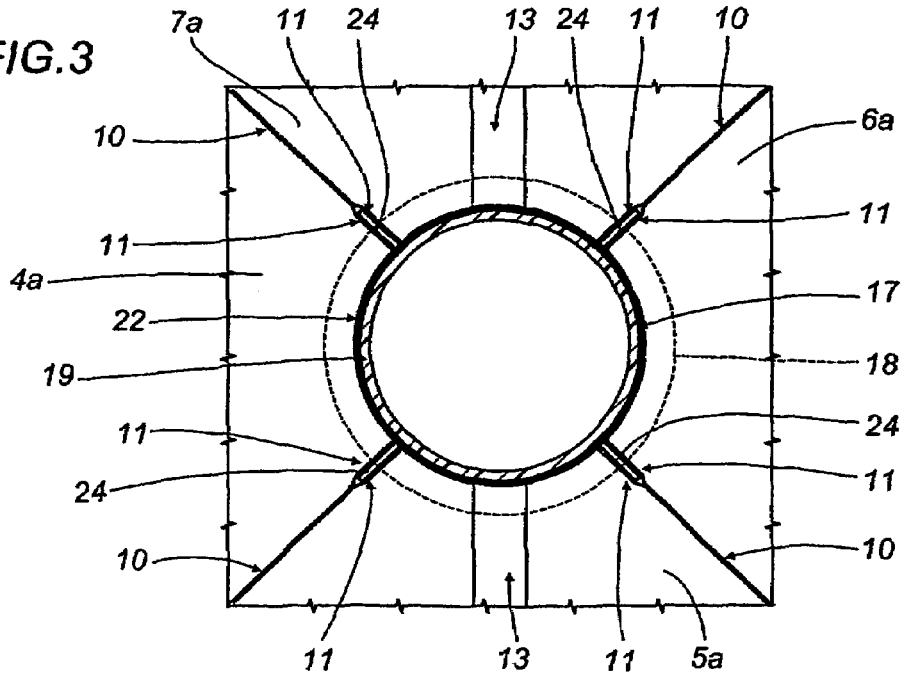
FIG. 3 is a schematic plan view of the container of FIGS. 1 and 2, illustrated with certain parts omitted and others in section.

The container 1 of FIGS. 1, 2 and 3 comprises a tubular container body 2 referable to a predominating vertical axis A, presenting a base 3 of quadrangular geometry and four vertical side walls 4, 5, 6 and 7.

Each of the vertical side walls 4, 5, 6 and 7 lies parallel to the wall 4, 5, 6 and 7 opposite, and normal to the two adjoining walls 4, 5, 6 and 7.

The vertical side walls 4, 5, 6 and 7 are separated one from the next by respective vertical corner edges denoted 8.

The container 1 also comprises a top section 9 presenting four angled faces denoted 4*a*, 5*a*, 6*a* and 7*a*, each extending upward from a respective vertical side wall 4, 5, 6 and 7.

Each of the angled faces 4*a*, 5*a*, 6*a* and 7*a* is joined to the faces 4*a*, 5*a*, 6*a* and 7*a* on either side by respective first raised and welded seams 10.

Each first seam 10 is obtained by lapping together and welding two edges 11 (see FIG. 3) of the aforementioned blank of paper material.

The first seams 10 constitute respective joined areas 12 along which the angled faces 4*a*, 5*a*, 6*a* and 7*a* are connected.

The tubular container body 2 is erected in familiar manner from a blank of paper material, and in such a way that two mutually opposed vertical side walls 5 and 7 will present two respective second longitudinal welded seams 13, each flattened against the relative vertical side wall in a configuration such as to minimize the corresponding transverse dimension of the body 2.

Each vertical side wall 4, 5, 6 and 7 is delimited at bottom by the aforementioned quadrangular base 3, laterally by the vertical corner edges 8, and uppermost by a horizontal corner edge 14 that also coincides with a crease line 14*a* delimiting the relative angled face 4*a*, 5*a*, 6*a* and 7*a*.

The four angled faces 4*a*, 5*a*, 6*a* and 7*a* converge from the relative horizontal crease lines 14*a* toward a spout 15 from which the contents of the container 1 can be poured, combining thus to establish a frustopyramidal section 16 of the selfsame container.

The spout 15 appears as a cylindrical tubular element 17 of plastic material, presenting a flanged annular part 18, and on either side of the annular part, a bottom first portion 19 (illustrated in FIGS. 5 to 9) and a top second portion 20.

The top second portion 20 is threaded in such a way as to receive a respective screw cap 21 providing a closure for the container 1, illustrated in FIG. 2.

The top ends of the angled faces 4*a*, 5*a*, 6*a* and 7*a* combine to create an annular top edge 22 of the container 1, which is connected to the aforementioned bottom first portion 19 of the tubular element 17 by means of a weld.

Referring to FIG. 2, the flanged annular part 18 presents a shoulder 23 offered to the annular edge 22 of the container and serving to ensure that the tubular element 17 is positioned correctly in relation to the annular edge 22.

As discernible in FIG. 3, the bottom first portion 19 of the tubular element 17 presents four substantially radial projections 24 equispaced around the periphery of the selfsame element and separated thus one from the next by a right angle.

The first raised seams 10 are able to engage the projections 24 of the annular element at respective points near the annular top edge 22.

In other words, each projection 24 coincides with a given portion of the joined area 12, locating between two edges 11 of the blank that are united in lapping contact and welded to form the first seams 10.

Figure 5:
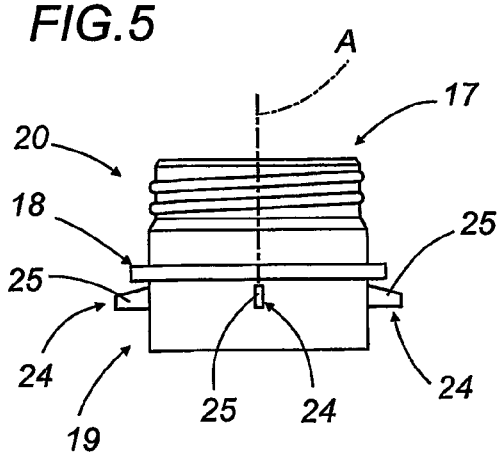
FIGS. 5 to 9 show a detail of the container as in FIGS. 1, 2, 3 and 4 illustrated in five alternative embodiments and viewed in respective schematic side elevations.

In the example of FIG. 5, the projection 24 consists in a tag 25 of polygonal outline cantilevered from the bottom first portion 19 of the tubular element 17.

Figure 6:
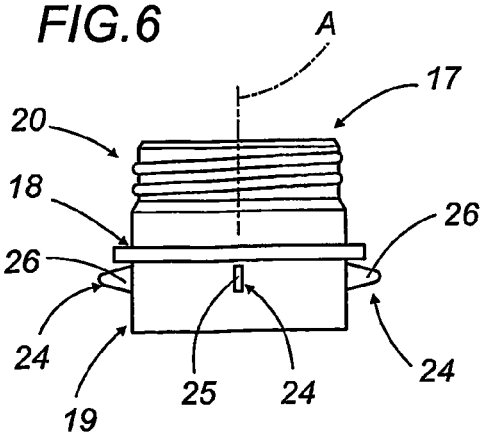
Figure 7:
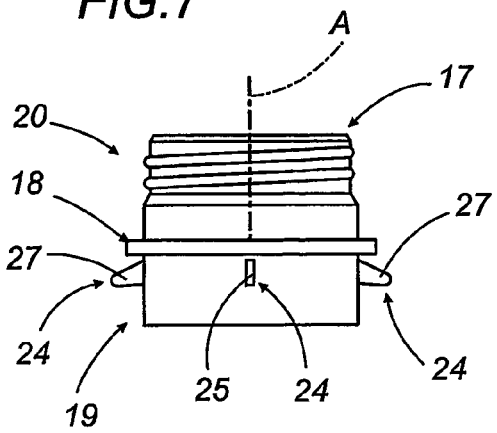

In the examples of FIG. 6 and FIG. 7, the projection 24 consists in a tag of rounded outline, denoted 26 and 27 respectively. These tags 26 and 27 likewise are cantilevered from the bottom first portion 19 of the tubular element 17. The tag 27 of FIG. 7 is angled advantageously downwards, matching the angle of the first welded seams 10.

Figure 8:
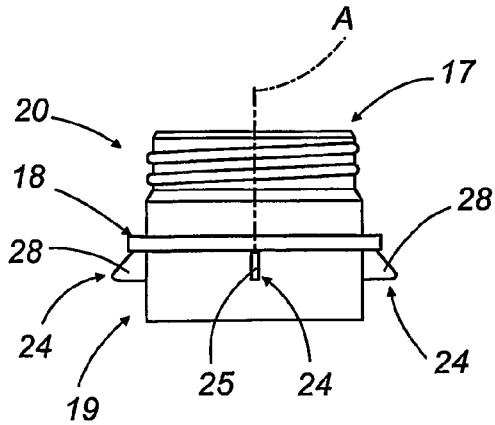

In the example of FIG. 8, the projection 24 consists in a tag 28 of polygonal outline anchored both to the bottom first portion 19 and to the shoulder 23 of the flanged annular part 18.

Figure 9:
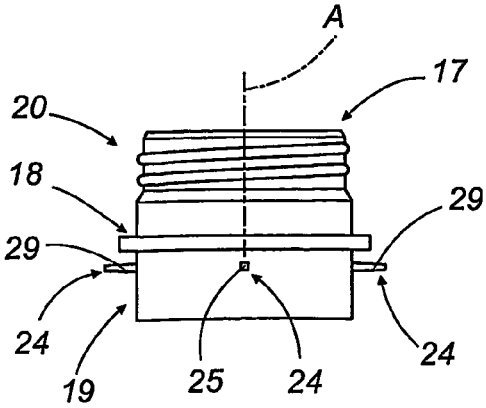

In the example of FIG. 9, the projection 24 consists in a peg 29.

Referring again to FIGS. 1, 2 and 3, the tubular container body 2 is formed by bending the blank of material along the aforementioned vertical corner edges 8 and welding the longitudinal seams 13, so as to create a semi-erected tubular component (not illustrated) centred on the predominating axis A, then folding one end of the semi-erected tubular component inwards to form the quadrangular base 3.

The four angled faces 4*a*, 5*a*, 6*a* and 7*a* are joined and welded together along the first seams 10, and substantially as part of this same step, the tubular element 17 is secured by welding to the annular top edge 22 of the container 1.

During the course of this welding step, each of the projections 24 located between the two corresponding edges of the blank will be melted at least in part by the welding means (conventional, and not illustrated) so that the plastic material of the projection 24 is actually incorporated as a sealing medium into the closure of the container 1.

In other words, the plastic material of the projections 24 is designed to function as a filler material in the welded assembly and thus to help ensure an effective seal of the joined areas 12, which are especially critical to the sealing action at the annular top edge 22.

Advantageously, the elevation of the first raised and welded seams 10 from the surface of the angled faces 4*a*, 5*a*, 6*a* and 7*a* has the effect of improving the mechanical strength of the top section 9 significantly, in terms of its resistance to crushing forces along the main axis A.

Figure 4:
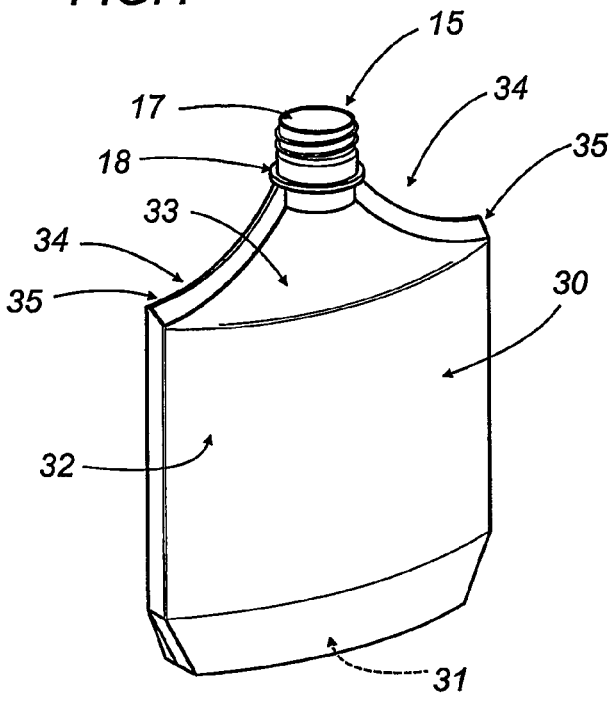
FIG. 4 illustrates a different embodiment of the container according to the present invention, viewed in perspective from above.

An alternative embodiment of the container 1 illustrated in FIG. 4 comprises a flat body 30 of substantially elliptical cross section referable to a predominating vertical axis A, presenting a base 31 and two mutually opposed side walls 32 of convex profile.

The container 1 further comprises a top section 9 presenting two angled faces 33, each associated respectively with one of the side walls 32. The side walls 32 and the respective angled faces 33 are joined one to another by respective welded seams 34.

Each welded seam 34 is obtained by lapping and welding together two edges 35 of the blank of paper material from which the container 1 is made.

In like manner to the example of FIGS. 1, 2 and 3, the container 1 presents a spout 15 provided by a cylindrical tubular element 17 of plastic material presenting a flanged annular part 18, and on either side of the annular part, a bottom first portion 19 and a top second portion 20.

Unlike the first embodiment, and as a direct result of there being only two angled faces 33, the tubular element 17 presents just two substantially radial projections 24, not illustrated in the drawings, equispaced angularly at 180° and designed to locate between the two edges 35 of the blank that are lapped and welded to form the seams 34.

Figure 10:
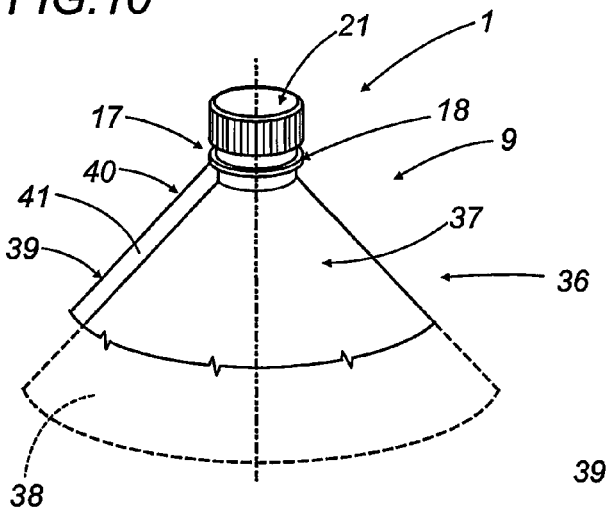
FIG. 10 illustrates a portion of a further embodiment of the container according to the present invention, viewed in perspective from above.
Figure 11:
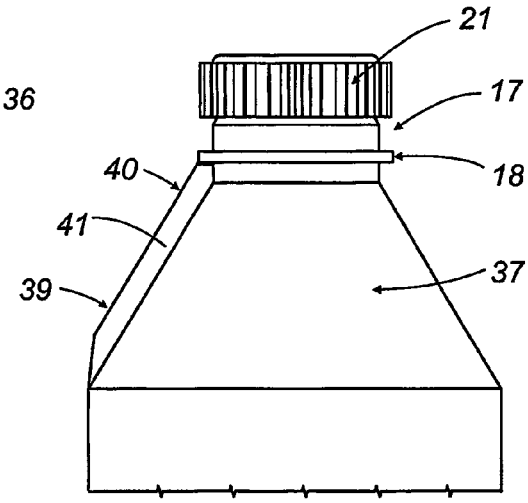
FIG. 11 illustrates the portion of the container shown in FIG. 10 furnished with a cap, viewed in a schematic side elevation.
Figure 12:
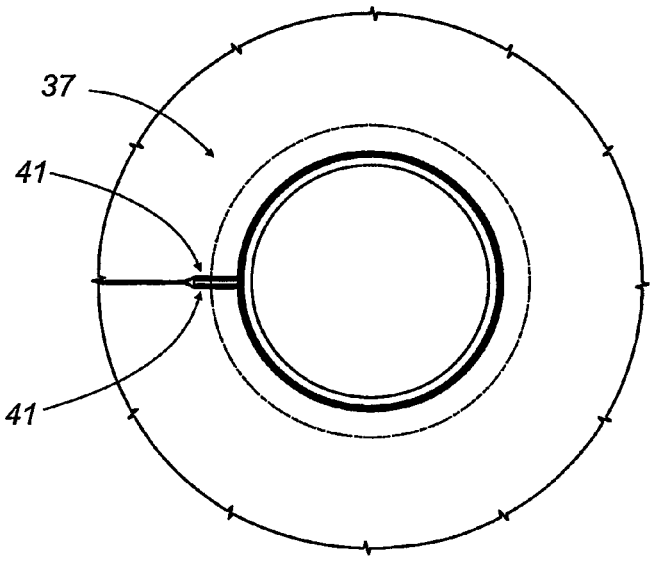
FIG. 12 is a schematic plan view of the container of FIGS. 10 and 11, illustrated with certain parts omitted and others in section.

FIGS. 10, 11 and 12 illustrate a further embodiment of the container 1 of which the body 36, indicated only in part, is surmounted by a top section 9 consisting in a frustoconical wall 37.

The frustoconical wall 37 is referable to a cone denoted 38, and presents a raised and welded seam 39 establishing a joined area 40 on the selfsame wall 37 that extends along a generator (not indicated in the drawing) of the reference cone 38.

The welded seam 39 is obtained by lapping and welding together two edges 41 of the blank of paper material from which the frustoconical wall 37 is fashioned.

In like manner to the example of FIGS. 1, 2 and 3, the container 1 presents a spout 15 provided by a cylindrical tubular element 17 of plastic material presenting a flanged annular part 18, and on either side of the annular part, a bottom first portion 19 and a top second portion 20.

Figure 13:
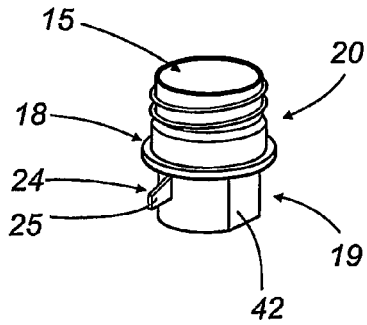
FIG. 13 illustrates a further embodiment of the detail shown in FIGS. 5 to 9, viewed in perspective from above.

Unlike the first embodiment, and as a direct result of there being only one welded seam 39, the tubular element 17 presents just one projection 24, illustrated in FIG. 13, designed to locate between the two edges 41 of the blank that are lapped and welded to form the seam 39.

Advantageously, a tear-open element of conventional type (not illustrated) is located between the annular flange part and the cap to maintain the hermetic seal of the closure and prevent accidental or unwarranted opening of the container 1.

In the example of FIG. 13, the bottom first portion 19 of the tubular element 17 presents a flat peripheral zone 42 functioning as a reference that serves to ensure the tubular element 17 will assume a given position relative to the annular top edge 22 of the container 1.

In a further alternative embodiment of the container 1, not illustrated in the drawings, the tubular element 17 presents a bottom first portion 19 of quadrangular shape, and a second top portion 20 of cylindrical shape similar to that already described.

The invention claimed is:

1. A container fashioned from a blank of multi-layer paper material, comprising:

a tubular element associated with a top section of the container and providing a spout from which to pour a product held internally of the selfsame container, the top section including at least two edges of the blank united in lapping contact to establish a joined area, the tubular element has four projections wherein at least one projection is interposable between the edges of the blank and welded together with at least a portion of the area along which the selfsame edges are joined, wherein the container comprises a substantially parallelepiped body, the top section of the container presenting four faces extending from respective walls of the parallelepiped body and converging toward the tubular element, the four projections distributed around the periphery of the tubular element and interposable between corresponding edges constituting respective joined areas for said four faces of the top section of the container;

the container including an annular top portion having intermediate portions disposed between the respective joined areas, the intermediate portions connected to respective ones of the four faces and formed to extend upwardly away from the four faces at respective obtuse angles thereto, to form a collar externally protruding from and above the four faces that aligns with and closely fits bottom first portions of the tubular element positioned between the projections.

2. A container as in claim 1, wherein the tubular element comprises a flanged annular part against which a top edge of the container is caused to register.

3. A container as in claim 2, wherein the tubular element comprises a bottom first portion located on one side of the flanged part, incorporating the projection and positioned to connect with the top edge, also a top second portion located on the opposite side of the flanged part and designed to couple with a closure element of the container.

4. A container as in claim 1, wherein the four faces are connected one to another by way of the joined areas along which the edges of the blank of paper material are united.

5. A container as in claim 4, wherein the joined areas are disposed in alignment with respective corner edges separating the walls of the parallelepiped body.

6. A container as in claim 1, wherein the projection interposable between the edges constituting the joined area appears as a tag of polygonal outline.

7. A process as in claim 6, wherein the tag is fixed to and cantilevered from the bottom first portion of the tubular element.

8. A container as in claim 1, wherein the projection interposable between the edges constituting the joined area appears as a tag of rounded outline.

9. A container as in claim 1, wherein the projection interposable between the edges constituting the joined area consists in a peg fixed to and cantilevered from the tubular element.

10. A container as in claim 1, wherein the projection interposable between the edges constituting the joined area serves as a filler material with which to weld the edges.

11. A container as in claim 1, wherein at least the bottom first portion, of the tubular element presents a flat zone functioning as a reference determining the position of the tubular element relative to the top section of the container.

* * * * *